United States Patent [19]

Waymouth

[11] Patent Number: 5,051,649

[45] Date of Patent: Sep. 24, 1991

[54] ARC DISCHARGE LAMP WITH LIQUID METAL AND HEATING MEANS

[75] Inventor: John F. Waymouth, Marblehead, Mass.

[73] Assignee: John F. Waymouth Intellectual Property and Education Trust, Marblehead, Mass.

[21] Appl. No.: 405,209

[22] Filed: Sep. 8, 1989

[51] Int. Cl.[5] ..... H01J 61/20; H01J 61/60; H01J 7/30; H01J 7/24

[52] U.S. Cl. ..... 313/15; 313/172; 313/565; 313/595; 313/635; 315/49; 315/115

[58] Field of Search ..... 313/172, 15, 232, 635, 313/595, 565; 315/49, 115

[56] References Cited

U.S. PATENT DOCUMENTS

| | | | |
|---|---|---|---|
| 1,022,009 | 4/1912 | Weintraub | 315/115 |
| 1,343,037 | 6/1920 | Cornu | 313/15 |
| 1,656,898 | 1/1928 | Belleaud et al. | 313/27 |
| 1,908,649 | 5/1933 | Spaeth | 313/565 X |
| 1,991,350 | 2/1935 | Green | 313/172 X |
| 2,006,466 | 7/1935 | Ludwig | 313/172 X |
| 2,336,183 | 12/1943 | McKinley et al. | 313/565 X |
| 2,902,618 | 9/1959 | De Lany et al. | 313/635 X |
| 3,488,761 | 1/1970 | Ito et al. . | |
| 3,501,730 | 3/1970 | Ito et al. . | |
| 3,513,426 | 5/1970 | Inowe et al. . | |
| 3,529,210 | 9/1970 | Ito et al. . | |
| 3,559,138 | 1/1971 | Itoh et al. . | |
| 3,599,137 | 8/1971 | Ito et al. . | |
| 3,611,041 | 10/1971 | Itoh et al. . | |
| 3,611,237 | 10/1971 | Yamagata . | |
| 3,644,860 | 2/1972 | Yamagata et al. . | |
| 3,670,282 | 6/1972 | Itoh et al. . | |
| 3,745,309 | 7/1973 | Gruss . | |
| 3,745,369 | 7/1973 | Yamagata . | |
| 3,747,040 | 7/1973 | Inoue et al. . | |
| 3,753,190 | 8/1973 | Ito et al. . | |
| 3,838,373 | 9/1974 | Inoue et al. . | |
| 3,886,511 | 5/1975 | Miyamoto et al. . | |
| 3,902,150 | 8/1975 | Wada et al. . | |
| 3,973,233 | 8/1976 | Miyamoto et al. . | |
| 4,153,861 | 5/1979 | Warner et al. | 313/594 X |
| 4,523,126 | 6/1985 | Hammer et al. | 313/594 |

*Primary Examiner*—Palmer C. DeMeo
*Attorney, Agent, or Firm*—Edward A. Gordon

[57] ABSTRACT

A ballastless high pressure discharge lamp includes an arc tube, electrodes disposed in the arc tube, a column of mercury disposed in the arc tube and having a volume less than the volume of the arc tube, and cushion material disposed in the arc tube adjacent at least one of the electrodes. The cushion material comprises an inert gas impinging upon at least one end of the column of mercury. At least one of the electrodes extends into the column of mercury. The discharge lamp also includes a heating member disposed adjacent the arc tube to separate the column of mercury into two sub-columns by the vaporization of a portion of the mercury column to thereby form a space between the two sub-columns and compress the cushion material and allow one of the mercury sub-columns to engage one of the electrodes whereby to form an arc in the space between the two sub-columns of mercury.

14 Claims, 5 Drawing Sheets

$$L = 2L_0 (1 - P_{GB} / P_{HG})$$

$$\frac{IV}{\pi DL} = \text{DESIGN WALL LOADING}$$

$$P_{HG} = F\left\{\frac{IV}{\pi DL}\right\}$$

ARC DISCHARGE LAMP WITH LIQUID METAL AND HEATING MEANS

BACKGROUND OF THE INVENTION

1. Field Of The Invention

The present invention relates to arc discharge lamps and more particularly to an arc discharge lamp which does not require a conventional ballast for operation.

2. Description Of Background Art

Typical high pressure discharge lamps comprise an arc tube which is hermetically sealed and has an electrode in each end. Within the arc tube is a quantity of mercury, a halide and a fill gas, for example. The arc tube is disposed within a conventional outer glass jacket with suitable lead-in wires.

It has long been known that electric discharge lamps require auxiliary circuits to ignite the discharge and to control the flow of current therethrough. This results from the fact that, first, the ignition voltage of such devices is higher than the operating voltage, and that, second, the operating voltage typically decreases with increasing current. Consequently if such a device is connected directly to the electric power lines, it either will not ignite, or if it does so, the current will increase rapidly to destructive levels.

As is well known, the usual type of arrangement for a high pressure discharge lamp includes a starter electrode, two principal electrodes, a switch and a ballast. The type of ballast depends on the wattage of the lamp and the voltage of the supply circuit. For example, the ballast may be a transformer type, a choke type, or a combination of transformer, inductance and capacitance.

The ignition process in prior art high pressure discharge lamps wherein the ballast is a choke coil is now described. When the switch is closed, an electric current flows through one of the principal electrodes and the starter electrode that is disposed adjacent to it. The discharge between the electrode and the starter electrode provides a plentiful supply of free electrons which aids the establishment of an arc between the two principal electrodes. The current through this arc is limited by the impedance of the choke. The heat from the arc vaporizes the mercury, raising the mercury pressure to the extent that the arc emits a brilliant light.

The behavior of an arc in a high pressure discharge lamp is quite different from the operation of an incandescent lamp. The high pressure discharge lamp is not a self-limiting device. An incandescent filament can only conduct a certain current for a given voltage because its resistance would increase if it gets hotter. However, as an arc becomes hotter, the resistance to the flow of electrons decreases. So the arc in a high pressure discharge lamp would "run away with itself" and destroy the lamp if it were not held back. This is the most important purpose of the ballast control circuit, whether it be a choke coil, a condenser, or a resistance.

As a result, the applications of electric arc discharge lamps have been limited to special fixtures equipped with such control circuits, called "ballasts". Arc discharge lamps cannot be used as direct substitutes for incandescent lamps in existing sockets. Although discharge lamp products have been and are presently on the market for such substitution, they incorporate the ballast circuit integrally in the housing or base of the lamp which greatly increases the cost of the product. Alternatively, the product may employ a "ballast adapter" which is inserted into the incandescent lamp socket, with a receptacle for connection to the discharge lamp. Such devices are cumbersome and costly. Consequently, even with these modifications, arc discharge lamps have not found significant application as incandescent lamp replacements. Therefore, the commercial and residential customers have been unable to enjoy to the fullest degree the significant energy saving that results from the lower power consumption of discharge lamps for the same light output, in comparison to incandescent lamps.

Despite the fact that this defect of discharge lamps has been known since the first large-scale commercial use of such lamps in the first decade of this century such as, for example, "COOPER-HEWITT" lamps, and despite the fact that many generations of lamp development engineers and scientists have addressed the problem, no practical ballastless discharge lamps have ever been provided.

It has also been known for many years that some electric discharge lamps have so called "positive volt-ampere characteristics", that is, over at least certain ranges of currents, the operating voltage of the discharge lamp increases with increasing current. An example of such a characteristic is set forth in the book entitled: *The High Pressure Mercury Vapour Discharge* by W. Elenbaas, North Holland Publishing Co., Amsterdam, 1951. As disclosed therein with respect to FIG. 19, E is the axial voltage gradient in the discharge, and P is the power input per unit length. Since operating voltage is equal to E times arc length plus electrode drop, and P equals axial electric field times current, from this curve can be constructed a curve of operating voltage versus discharge current, which illustrates that above a certain value of current, discharge operating voltage increases slowly with increasing current. It is described in the subject reference that the formula for axial voltage gradient is given by:

$$E = \frac{6.0\, P^{1/2}\, M^{7/12}}{(P-9)^{1/3}\, D^{3/2}}\ V/CM \qquad \text{Eq. 1}$$

in which D is inside diameter of the discharge tube and M is mass of mercury vapor per unit length in mg/cm.

Despite the known existence of such a positive region to the Volt-ampere curve of a high-pressure mercury vapor discharge lamp, no practical ballastless lamps have ever been constructed on this principle. The problem is twofold: first, the high pressure discharge lamp cannot be ignited at the voltage drop at which it will operate on the positive branch of the V-I curve; and second, even if it could, the variation of discharge current within the normal range of tolerances of line voltages would be excessive and impractical. This can be shown by algebraic manipulation of Eq. 1, expressing P as equal to EI, and m in terms of the mercury vapor pressure in atmospheres, and focussing on the domain for P>40 w/cm (i.e.>>9)

$$E = 7.442\, I^{1/5} (P_{HG})^{7/10} / D^{2/5} \qquad \text{Eq. 2}$$

It can be seen that the axial voltage gradient increases as the 1/5 power of current. If the axial voltage gradient is fixed by the line voltage as $(V_L - V_K)/L$, solving for the current as a function of line voltage VL gives $$I = [(V_L - V_K)/7.442\ L]^5\ (D^2/P_{HG}{}^{7/2}) \qquad \text{Eq. 3}$$

in which $V_K$ is electrode drop, and all other symbols have been defined. It is clear that for a known high pressure mercury discharge lamp, with L, D and mercury pressure fixed as design parameters, variation in line voltage must be accompanied by substantial variations in lamp current. Because of the fifth power dependence, for example, a 10% line voltage variation will be accompanied by a 50% variation in lamp current. Since +/−10% variations in line voltage are within the tolerance a high pressure mercury discharge lamp in this mode would lead to unacceptably large variations in power and light output under normal conditions of use.

For the two reasons outlined, therefore, no ballastless lamps have been developed making use of the positive V-I characteristics of the high pressure mercury discharge, known at least since the publication of the above referenced Elenbaas book, nearly 40 years ago.

It has been known to ignite a discharge in mercury vapor with so-called "mercury pool cathodes" by establishing a connection of liquid mercury within the device between the lead-in wires, so that current flows through the circuit. An interruption of the liquid path breaks that connection, and permits the establishment of the discharge in mercury vapor with a mercury pool cathode. The already-cited "COOPER-HEWITT" lamps were ignited in this way by tipping the lamp longitudinally to establish a continuous liquid mercury connection between electrodes, and subsequently restoring it to a horizontal position to break the connection. While this form of interruption of the liquid path has been known for many years, no change or modification has ever been employed for the purpose of igniting a discharge lamp to operate at normal line voltage without a ballast.

Accordingly a principal desirable object of the present invention is to provide a discharge lamp arc tube capable of ignition at ordinary line voltages without transformer step-up, and capable of subsequent operation at a predetermined design current from the same line voltage without ballast (series impedance) of any kind.

Another desirable object of the present invention is to provide a discharge lamp having a substantially higher efficacy than incandescent lamps.

Another desirable object of the present invention is to provide a discharge lamp which can successfully replace an incandescent lamp in the self-same socket yielding either equivalent light output at substantial reduction in power consumption, or substantially more light at equal power consumption.

A still further desirable object of the present invention is to provide formulae to facilitate the design of the discharge lamps of the present invention to provide predetermined performance specifications.

These and other desirable objects of the invention will in part appear hereinafter and will in part become apparent after consideration of the specification with reference to the accompanying drawings and the claims.

SUMMARY OF THE INVENTION

There is provided a relatively simple and efficient arc tube for high pressure discharge lamps which eliminates the need for a ballast. The arc tube comprises an elongated hermetically sealed tubular member preferably formed of quartz or other silica glass and having disposed therein a predetermined amount of a vaporizable liquid metal occupying a volume less than that of the tubular member. A first primary electrode is sealed adjacent one end of the tubular member and extends sufficiently thereinto to achieve contact with the liquid metal during operation, and a second primary electrode is sealed adjacent the other end of the tubular member and extends sufficiently thereinto to achieve contact with the liquid metal during operation. An inert gas is disposed in the sections of the tubular column not filled with the liquid metal and in contact with the liquid metal. The pressure of the inert gas is sufficient to force the liquid metal into a single unitary column in contact with the first and second primary electrodes. The arc tube also includes heating means for heating a portion of the liquid metal column in a section of the tubular member between the first and second electrodes to a sufficient temperature to vaporize a portion of the liquid metal to provide a vapor pressure sufficiently greater than the pressure of the inert gas in the inert gas sections whereby the liquid metal column will be separated into two sub-column segments by the vaporized metal to thereby form a vapor contact arc between the separated liquid metal portions.

In a preferred embodiment, the inert gas filled sections or chambers are located at the distal ends of the arc tube and the heating means is positioned adjacent the center portion of the arc tube. A starting circuit is provided whereby the heating means is connected in series with the starter electrode and in parallel with one of the primary electrodes.

As briefly stated, in operation the heating means raises the temperature of the liquid metal, mercury for example, adjacent the heating means sufficiently to vaporize the liquid metal thereby forcing the liquid metal apart into two sub-columns which each move against the inert gas filled sections thereby compressing the inert gas in each inert gas section. The severing of the liquid metal column into two sub-column segments results in the occurrence of a contact arc which in turn establishes a liquid metal-pool cathode spot which permits discharge current to flow in the above atmospheric pressure liquid metal vapor. The compliant inert gas-filled sections or chambers yield by compression to permit a longer arc length when the line voltage increases (which is the result of increased vapor pressure of the liquid metal from the higher temperature) or form a shorter arc length when the line voltage decreases (which is the result of reduced liquid metal vapor pressure due to reduced temperature) whereby the compliant gas-filled sections serve to stabilize discharge current against line voltage changes and thereby prevent run-away voltage in the arc tube.

BRIEF DESCRIPTION OF THE DRAWING(S)

For a fuller understanding of the nature and desired objects of the invention, reference should be had to the following detailed description taken in connection with the accompanying drawings wherein like reference characters denote corresponding parts throughout the several views and wherein.

Figure 7A:
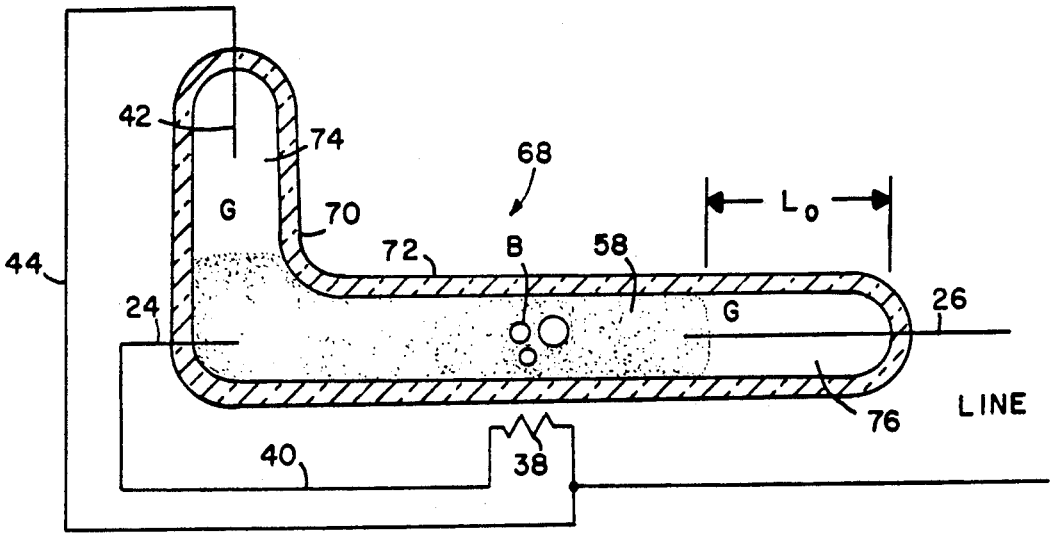
Figure 7B:
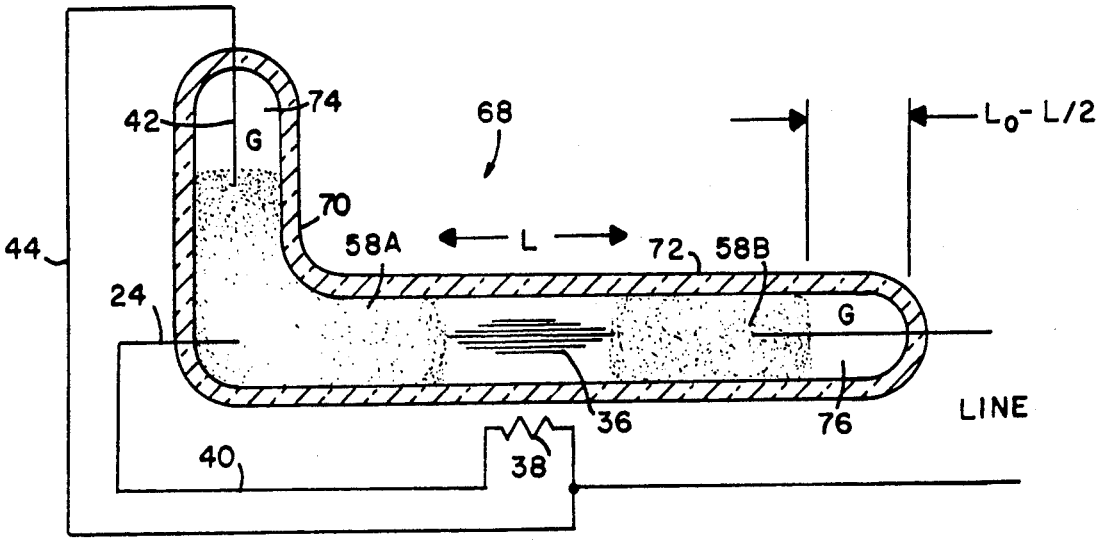
Figure 8:
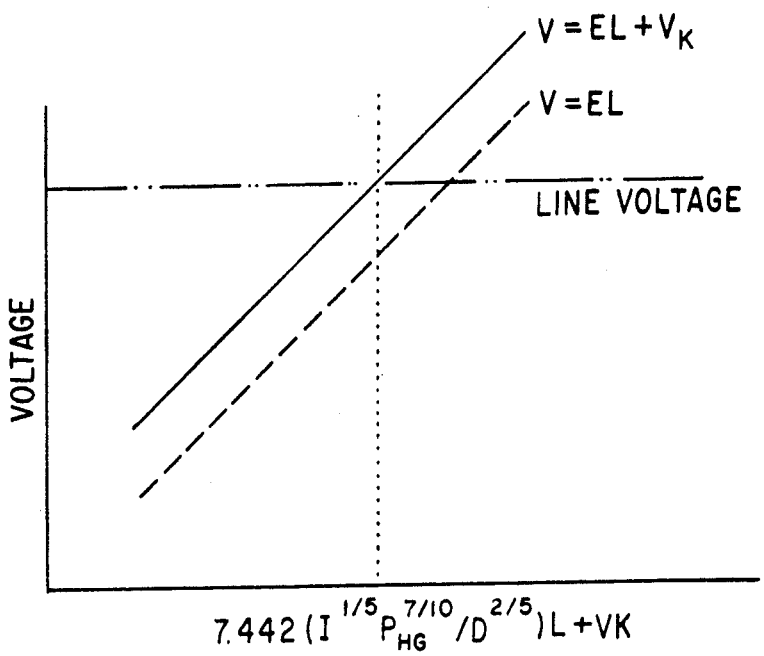

FIGS. 7A and B are schematic representations of another embodiment of the high pressure arc tube of the present invention in the starting mode (A) and in the operating mode (B); and FIG. 8 illustrates the structural formulae for design to predetermined performance specifications of arc tubes in accordance with the present invention for making of discharge lamps.

DETAILED DESCRIPTION OF PREFERRED EMBODIMENTS

Figure 1:
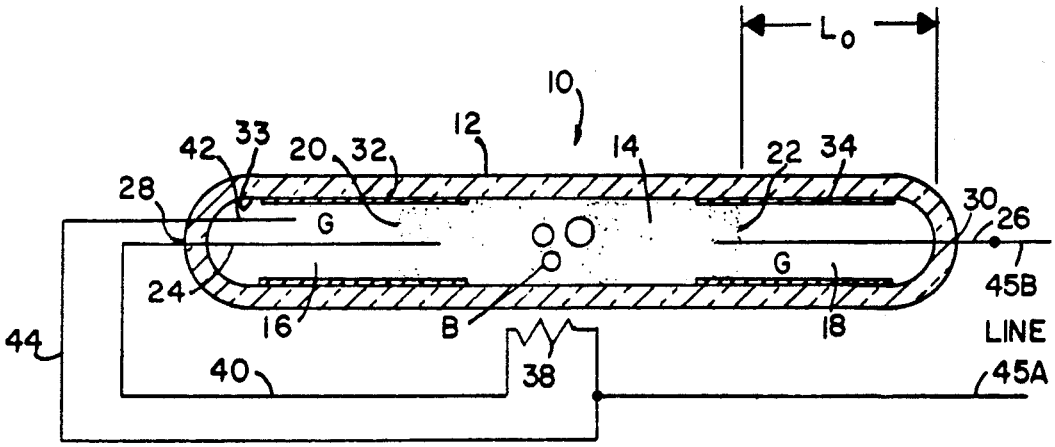
FIG. 1 is a cross-sectional view of an arc tube in the starting mode embodying the principles of the present invention.
Figure 2:
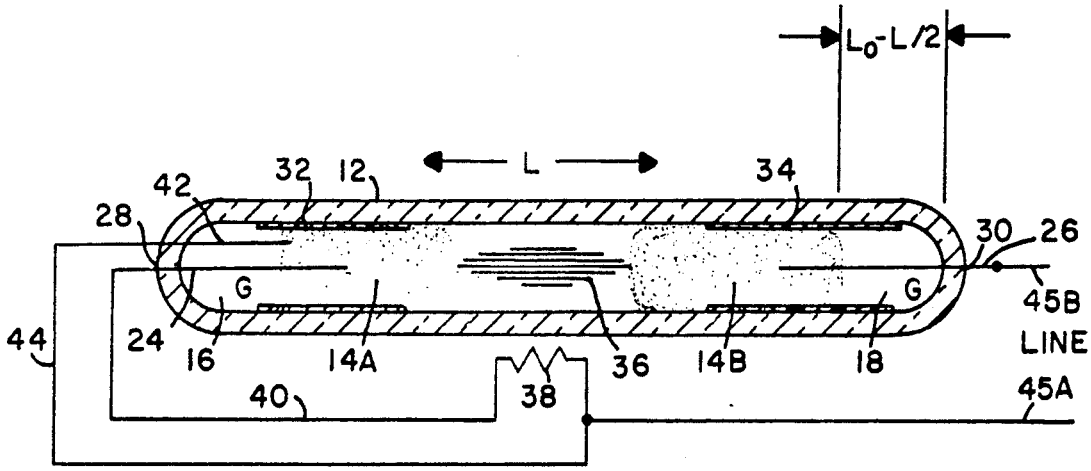
FIG. 2 is a cross-sectional view of the arc tube of FIG. 1 shown in the operating mode.

Referring now to the drawings and particularly to FIGS. 1 and 2, there is shown a high pressure arc tube (hereinafter sometimes referred to as "arc tube") embodying the principles of the present invention and indicated generally by the numeral 10. Referring more particularly to FIG. 1, (which represents the high pressure arc tube in the starting mode) the arc tube 10 comprises a tubular member 12 which can be formed of fused quartz or other high silica glass. Disposed within the tubular member 12 is a volume of vaporizable liquid metal 14. A suitable liquid metal is mercury. The volume of the liquid metal 14 is selected so that it is less than the volume of the tubular member 12 thereby providing spaces or sections 16 and 18 which are filled with an inert gas G such as argon to a selected pressure above atmospheric to exert sufficient pressure on the surfaces 20 and 22 of the liquid metal 14 to force the liquid metal as a continuous column in contact with the inner portions of ignition electrode 24 and principal electrode 26 which are sealed by conventional means in the respective adjacent ends 28 and 30 of the tubular member 12. In a preferred embodiment the portions of each of the inner surfaces of the tubular member 12 surrounding at least the inert gas sections 16 and 18 are provided with coatings 32 and 34 of a material which is wetted by the liquid metal such as mercury. A suitable wetting material for mercury is evaporated tungsten. It is to be understood that since the coating material is electrically conductive, it should not touch any of the electrode lead in connections, to avoid interference with the electrical current flow. The coating serves to eliminate microscopic voids along the interface between liquid metal and the inner surface 33 tubular member 12 through which high pressure inert gas G in the inert gas section might leak into the arc chamber. The arc tube member 12 also includes heating means for heating a portion of the liquid metal in the section of the tube between the ignition electrode 24 and principal electrode 26 to a sufficient temperature to vaporize a portion of the liquid metal to provide a vapor pressure sufficiently greater than the pressure of the inert gas in the inert gas sections 16 and 18 to separate the metal liquid column into two segments 14*a* and 14*b* (as illustrated in FIG. 2) thereby forming a vapor contact arc 36 between the separated liquid metal segments. As illustrated a suitable heating means comprises a resistance 38 positioned adjacent the tube member 12 and connected in series with electrode 24 by line 40. A second principal electrode 42 is sealed into the tube member 12 adjacent to the end 28 and ignition electrode 24. As best seen in FIG. 2 the principal electrode 42 does not contact mercury column 14*a* prior to ignition, but extends sufficiently into the tube member 12 to achieve contact with the segment 14A of the liquid metal when the liquid metal is separated into two sub-column segments during operation. The principal electrode 42 is connected by line 44 in parallel with the resistance 38 whereby the current essentially flows from power source line 45A through the principal electrode 42 during operation.

Figure 3:
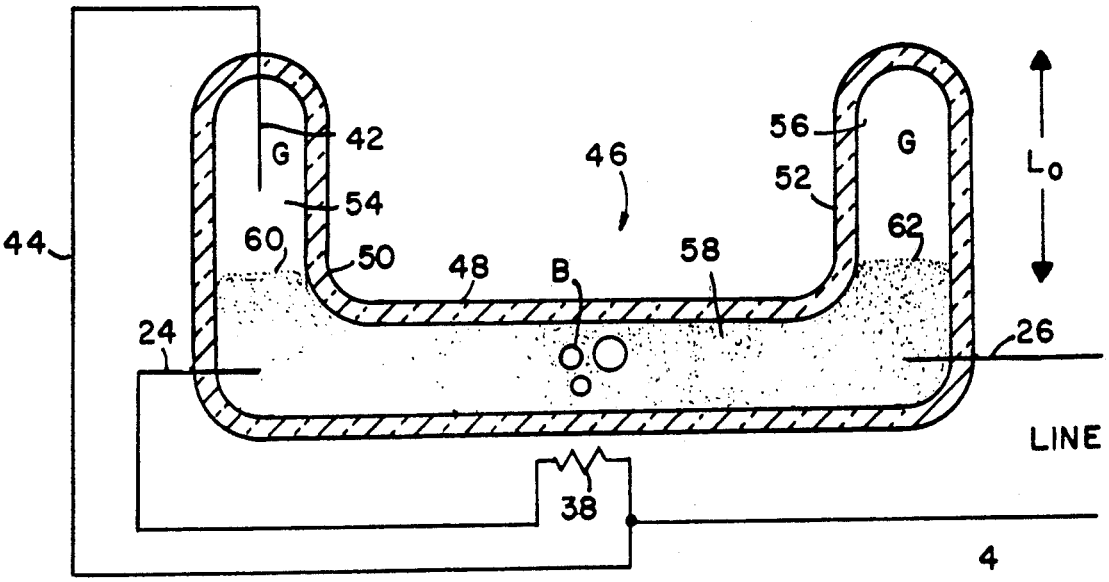
FIG. 3 is a cross-sectional view of an alternate embodiment of an arc tube in the starting mode embodying the principles of the present invention.
Figure 4:
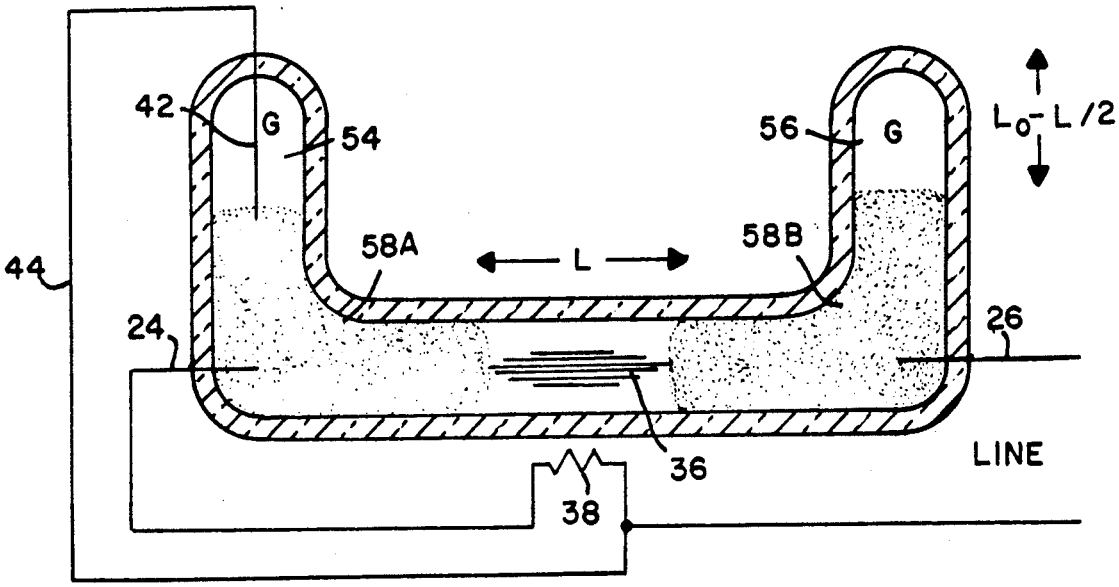
FIG. 4 is a cross-sectional view of the arc tube of FIG. 3 shown in the operating mode.

Referring now to FIGS. 3 and 4, there is illustrated an alternate embodiment of the arc tube of the present invention. The arc tube 46 of FIGS. 3 and 4 is similar to FIGS. 1 and 2 except that it is formed in a U-shaped configuration.

The arc tube 46 includes a horizontal center section 48 and two vertically opposing end sections 50 and 52. Each vertical section contains respectively sections 54 and 56 in which an inert gas G under pressure is contained as discussed with respect to FIGS. 1 and 2.

The operation of the arc tube will be discussed principally with reference to FIGS. 3 and 4. Attention is directed first to FIG. 3 representing the arc tube 46 in the unlighted state, with line voltage applied, ready to ignite. It will be seen that there is a continuous mercury column 58 between the ignition electrode lead-in 24 and principal electrode 26 at the distal ends of the horizontal portion of the tubular member 48. The current flow through this mercury column also flows through resistance 38, which may, for example, be a tungsten filament. The vertical sections 54 and 56 above the mercury column 58 are filled with an inert gas G such as argon to a pressure significantly above atmospheric. This exerts pressure on the surfaces 60 and 62 of the mercury, forcing the mercury column 58 to remain in a full continuous connection between the ignition electrode 24 and principal electrode 26.

The heat from the resistance 38 raises the temperature of the mercury in the immediate vicinity until its vapor pressure becomes greater than the pressure exerted upon the mercury by the inert gas G in the vertical sections 54 and 56. When this happens, the mercury boils generating bubbles B of vapor in the tubular member adjacent the resistance 38 thereby separating the mercury column into two sub-columns 58A and 58B, and forcing the two sub-columns of the severed column 58 apart against the pressure of the inert gas G in the vertical sections 54 and 56. The severing of the mercury column results in a contact arc 36 exactly similar to that upon the opening of a switch. This in turn establishes a mercury-pool cathode spot and permits discharge current to flow in the above atmospheric pressure mercury vapor.

The heat from the discharge further heats the mercury raising its vapor pressure and further forcing apart the two sub-columns 58A and 58B of the severed mercury column 58, further compressing the inert gas G in the vertical sections 54 and 56. As best seen in FIG. 4, this eventually results in the segment 58A of the liquid metal column contacting the principal electrode 42, which in turn is connected through connection 44 without any series impedance to the opposite terminal 45B of the power line from principal electrode 26. The current which flows is now controlled by the properties of the discharge volume and its arc length L. The resistance 38 is now effectively shorted out by the contact of the mercury sub-column 58A and the principal electrode 42 whereby little or no current flows through the resistance 38.

Referring now to FIG. 7A and B, there is illustrated a further embodiment of the present invention wherein the high pressure arc tube has an L-shaped configuration. The arc tube comprises an L-shaped tubular member 68 formed of two members 70 and 72. The ends of the members 70 and 72 are provided with spaces or sections 74 and 76 which are filled with an inert gas G to a selected pressure sufficient to force the liquid mercury 58 into a continuous column. In an alternative embodiment gas space 76 can be eliminated and the cushion can be provided solely by gas space 74. The remainder of the elements are similar to those of FIGS. 3 and 4 and have been so numbered. Also the operation of the high pressure arc tube 68 from the starting mode of A to the operating mode of B is the same as described with respect to the foregoing embodiments.

The operating characteristics of the device when the current path, for example in FIG. 4, is the series connection of electrode 26, column segment 58B, arc 36, column segment 58A, electrode 42 and connection 44 can be understood with the aid of the chart of FIG. 8. Because the effective resistance of the arc 36 is very much greater than the sum of all other series elements combined, the characteristics of arc 36 determine the current flow. The voltage drop in the arc, (which must equal the line voltage) is given as the product E times arc length L plus the electrode drop, as described in Eq 2. Note, however, that mercury pressure and arc length are no longer fixed design values.

Assume that for a discharge lamp operating stably at its design voltage and current (the dotted line in FIG. 8), line voltage increases. This results in an increase in current, raising the average gas temperature in the arc 36. Even at constant mercury density, the pressure of mercury increases. The increased mercury pressure forces the severed sections of the mercury column further apart against the restraining inert gas pressure in the vertical sections which act like cushions, increasing the arc length:

$$L=2L_O(1-P_{GB}/P_{HG}) \qquad \text{Eq. 4}$$

in which $P_{GB}$ is the initial filling pressure of inert gas in the inert gas sections ("gas ballast pressure"), and $L_O$ is the length of this inert gas section with the discharge lamp extinguished.

The increase in current also results in higher wall loading, and consequent higher wall temperature. Because there is liquid mercury in contact with the wall, the vapor pressure of mercury increases as wall temperature increases, resulting in further elongation of the arc length L.

As a consequence of the increase in both $P_{HG}$ and L when line voltage increases, the increase in current required to keep total lamp operating voltage equal to line voltage is reduced significantly below what would be required if $P_{HG}$ and L were fixed at lamp manufacture.

Similarly a decrease in line voltage resulting in reduced current causes a reduction in mercury pressure and arc length as the gas ballast pressure forces the two halves of the severed mercury column closer together.

The compliant cushion-like inert gas-filled chamber sections yielding to permit longer arc length when line voltage increases, or forcing shorter arc length when line voltage decreases, thus serve to stabilize discharge current against line voltage changes.

When the discharge lamp is shut off, the mercury pool cathode spot zone cools down so that the mercury vapor pressure decreases therein. When it drops below the pressure of the inert gas sections, the two subcolumns of the mercury column are forced together to be reconnected for the next ignition.

In accordance with the present invention the following DESIGN EQUATIONS or formulae provide for the design of arc tubes for discharge lamps to predetermined performance specifications:

$$V=[7.442\, I^{1/5}\,(P_{HG})^{7/10}/D^{2/5}]\, L+VK$$

$$L=2L_O(1-P_{GB}/P_{HG})$$

$$IV/(\pi\, DL)=\text{DESIGN WALL LOADING}$$

$$P_{HG}=F\,\{IV/(\pi\, \text{DL})\}$$

Given specified values of V and I, the designer may choose a safe value of wall loading consistent with long life, and a convenient value of $L_O$. The four equations then permit determination of mercury pressure, bore diameter, L, and $P_{GB}$.

The relationship between mercury vapor pressure and design wall loading is determined by the heat dissipation characteristics of the arc tube, which determine the maximum and cold spot temperatures for a given heat load.

While the invention has been described with respect to specific embodiments, modifications can be made within the scope of the invention.

Figure 5:
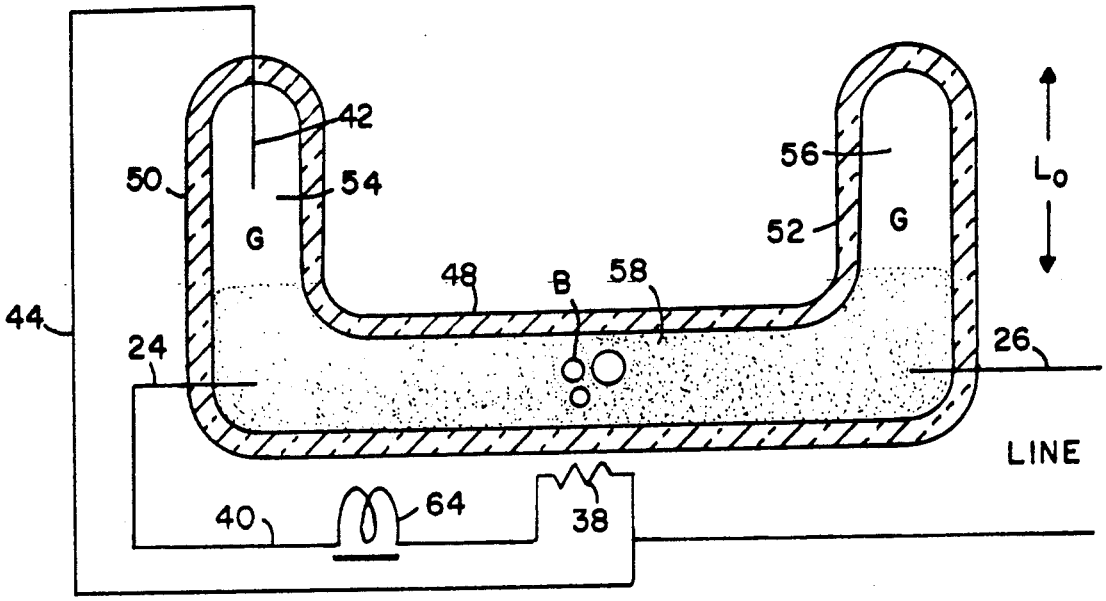
FIG. 5 is a cross-sectional view of the arc tube of FIG. 3 modified to provide inductive pulse at severing of the liquid metal column.

As illustrated in FIG. 5, a small inductor 64 can be provided in the starting line 40 for the purpose of providing a high voltage pulse at severing of the mercury column. Since the inductor 64 is not in the main discharge path, it therefore exerts no limitation on operating discharge current.

Figure 6:
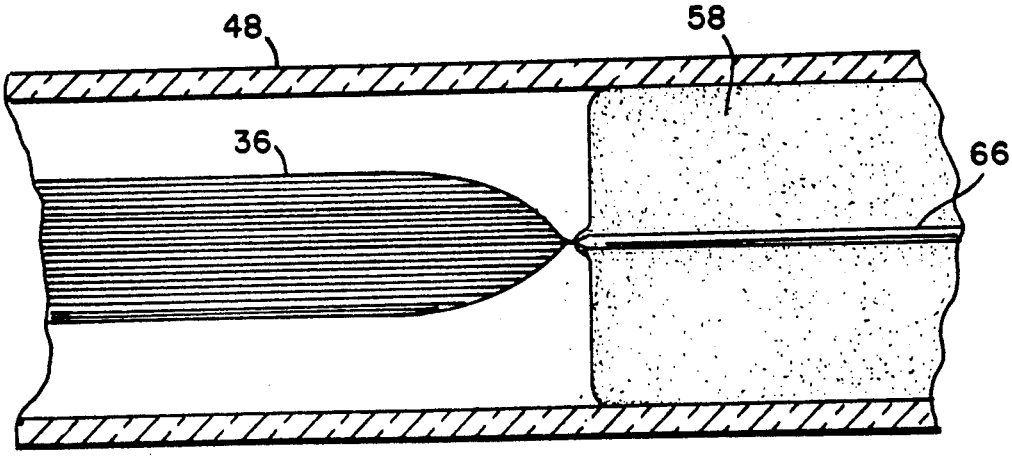
FIG. 6 is a fragmentary enlarged cross-sectional view of a modified embodiment of the arc tube of the present invention.

As shown in FIG. 6, a pointed metal electrode 66 can be provided within the mercury pool to serve as the cathode in a DC operated discharge lamp in order to stabilize the location of the cathode spot and minimize random flickering.

While the internal diameter of the tube has been shown to be constant, differences in diameter between arc cavity and the inert gas sections, or variations in diameter at different locations in the liquid metal column are also within the scope of the invention.

It is to be understood that when the arc tube is employed in a discharge lamp required to be operated on a DC current source to avoid difficulties in re-ignition of a cathode spot at each pool on alternate half cycles, the invention contemplates the use of a diode bridge and filter capacitor attached to the lamp to provide AC to DC conversion (without introducing any significant series impedance).

Additionally it is to be understood that other additives may be utilized within the arc tube. For example, cadmium or zinc may be added in small quantities to the liquid mercury, to provide admixtures of their vapors in the arc, as is known to the prior art of high pressure discharge lamps. Similarly, additions of vaporizable metal halides may be added for improved color and luminous efficacy of the arc as is also known in the art.

While the invention has been described with respect to preferred embodiments, it will be apparent to those skilled in the art that changes and modifications may be made without departing from the scope of the invention herein involved in its broader aspects. Accordingly, it is intended that all matter contained in the above description, or shown in the accompanying drawing shall be interpreted as illustrative and not in limiting sense.

I claim:

1. A high pressure discharge device comprising:

a hermetically sealed arc tube member having two ends disposed in said device;

a determined quantity of a vaporizable liquid metal disposed in said arc tube and having a volume less than that of the volume of the arc tube member whereby to leave a space at at least one end of the arc tube;

a resistance means for heating the liquid metal;

a first principal electrode sealed adjacent one end of said arc tube member, said first electrode extending sufficiently thereinto to achieve contact with said liquid metal;

a second principal electrode sealed adjacent the other end of said arc tube member, said second electrode extending sufficiently thereinto to achieve contact with said liquid metal during operation of said device;

a third electrode having one end connected in series with said resistance means and the other end sealed in said arc tube member and connected in parallel with the second electrode;

said third electrode extending sufficiently into said arc tube member to achieve contact with a segment of the liquid metal at all times;

an inert gas disposed in the sections of the arc tube not filled with liquid metal and in contact with the liquid metal;

said inert gas being at sufficient pressure to force the liquid metal away from said first electrode; and wherein said resistance means heats a portion of the liquid metal in the section between the first and second electrodes to a sufficient temperature to vaporize a portion of the liquid metal to provide a vapor pressure of said liquid metal sufficiently greater than the pressure of the inert gas in the inert gas sections whereby the liquid metal is separated into two sub-columns by the vaporized metal;

said vaporized metal forming a vapor contact arc between the separated liquid metal sub-columns.

2. The high pressure discharge device according to claim 1 wherein the arc tube member has a generally elongated straight configuration.

3. The high pressure discharge device according to claim 1 wherein the arc tube member has a generally U-shaped configuration.

4. The high pressure discharge device according to claim 1 wherein the arc tube member has a generally L-shaped configuration.

5. The high pressure discharge device according to claim 1 wherein at least a portion of the inner surface of the arc tube member forming the inert gas sections is coated with a material wetted by the liquid metal.

6. A high pressure discharge device comprising:

an arc tube member with an elongated hermetically sealed tubular member having a horizontal section and at least one vertical section communicating with said horizontal section;

a predetermined amount of a vaporizable liquid metal disposed in the arc tube member and having a volume less than that of the tubular member;

a resistance means for heating the liquid metal;

a first electrode sealed in one end of the horizontal tubular section and extending sufficiently thereinto to provide contact with said liquid metal;

a second electrode sealed in the end of the vertical section and extending sufficiently thereinto to provide contact with said liquid metal during operation of said high pressure discharge device;

a third electrode having one end connected in series with said resistance means and the other end sealed in said arc tube member and connected in parallel with the second electrode;

said third electrode extending sufficiently into said arc tube member to achieve contact with a segment of the liquid metal at all times;

an inert gas disposed in the sections of the tubular member not filled with liquid metal and said inert gas being in contact with the liquid metal;

said inert gas in each section being at sufficient pressure to force the liquid metal in continuous connection with said first electrode; and wherein said resistance means heats a portion of the liquid metal to a sufficient temperature to vaporize a portion of the liquid metal to provide a vapor pressure sufficiently greater than the pressure of the inert gas whereby the liquid metal can be separated into sub-columns by the vaporized metal and to force said liquid metal into contact with each of said electrodes and form a space between said columns;

and whereby said vaporized metal forms a vapor contact arc in the space between the separated liquid metal sub-columns.

7. The high pressure discharge device according to claim 6 wherein said liquid metal completely fills the horizontal section of the arc tube when said arc tube is not operating.

8. The high pressure discharge device according to claim 6 wherein at least a portion of the inner surface of the arc tube member forming the inert gas sections is coated with a material wetted by the liquid metal.

9. A high pressure discharge device comprising:

an arc tube;

a column of mercury disposed in said arc tube;

positive and negative electrodes disposed in said arc tube;

cushion means comprising an inert gas impinging upon at least one end of said column of mercury;

at least one of said electrodes extending into a portion of said column of mercury;

said negative electrode being connected to the negative terminal of a DC power source;

said negative electrode terminating in a metallic tip member within the arc tube; and heating means disposed adjacent said arc tube whereby to separate said column of mercury into two sub-columns by the vaporization of a portion of said mercury whereby to form a space between said two sub-columns and compress said cushion means and allow one of the mercury sub-columns to engage said negative electrode whereby to form an arc in the space between said two sub-columns of mercury;

said metallic tip member of said negative electrode connected to the negative terminal of the DC power source providing stabilization of the location of a mercury pool cathode spot formed by the arc in the space between the two sub-columns of mercury.

10. The high pressure discharge device according to claim 9 wherein the arc tube has a generally elongated straight configuration.

11. The high pressure discharge device according to claim 9 wherein the arc tube has a generally U-shaped configuration.

12. The high pressure discharge device according to claim 9 wherein the arc tube has a generally L-shaped configuration.

13. The high pressure discharge device according to claim 9 wherein at least a portion of the inner surface of the arc tube forming the inert gas sections is coated with a material wetted by the liquid metal.

14. A high pressure discharge device comprising:

an arc tube member with an elongated hermetically sealed tubular member having a horizontal section and two opposing vertical end sections communicating with said horizontal section;

a predetermined amount of a vaporizable liquid metal disposed in the arc tube member and having a volume less than that of the tubular member;

a first electrode sealed in one end of the horizontal tubular section and extending sufficiently thereinto to provide contact with said liquid metal;

a second electrode sealed in an end of one of the vertical sections and extending sufficiently thereinto to provide contact with said liquid metal during operation of said high pressure discharge device;

an inert gas disposed in a portion of each of the opposing vertical end sections of the tubular member not filled with liquid metal, said inert gas thereby being in contact with the liquid metal;

said inert gas in each section being at sufficient pressure to force the liquid metal in continuous connection with said first electrode; and means for heating a portion of the liquid metal to a sufficient temperature to vaporize a portion of the liquid metal to provide a vapor pressure sufficiently greater than the pressure of the inert gas whereby the liquid metal can be separated into sub-columns by the vaporized metal and to force said liquid metal into contact with each of said electrodes and form a space between said columns;

and whereby said vaporized metal forms a vapor contact arc in the space between the separated liquid metal columns.

* * * * *